US010763615B2

(12) United States Patent
Kawahara et al.

(10) Patent No.: US 10,763,615 B2
(45) Date of Patent: Sep. 1, 2020

(54) CONNECTOR STRUCTURE HAVING A LONGITUDINAL MOVEMENT RESTRICTING PROTRUSION

(71) Applicant: NIPPON TANSHI CO., LTD., Kanagawa (JP)

(72) Inventors: Yuzo Kawahara, Fujisawa (JP); Taichi Shimotomai, Fujisawa (JP)

(73) Assignee: NIPPON TANSHI CO., LTD., Kanagawa (JP)

( * ) Notice: Subject to any disclaimer, the term of this patent is extended or adjusted under 35 U.S.C. 154(b) by 0 days.

(21) Appl. No.: 16/615,929

(22) PCT Filed: May 24, 2018

(86) PCT No.: PCT/JP2018/020060
§ 371 (c)(1),
(2) Date: Nov. 22, 2019

(87) PCT Pub. No.: WO2018/225527
PCT Pub. Date: Dec. 13, 2018

(65) Prior Publication Data

US 2020/0212624 A1 Jul. 2, 2020

(30) Foreign Application Priority Data

Jun. 6, 2017 (JP) ..... 2017-111318

(51) Int. Cl.
*H01R 13/502* (2006.01)
*H01R 13/627* (2006.01)
*H01R 13/514* (2006.01)

(52) U.S. Cl.
CPC ..... *H01R 13/6272* (2013.01); *H01R 13/514* (2013.01)

(58) Field of Classification Search
CPC ..... H01R 13/514
(Continued)

(56) References Cited

U.S. PATENT DOCUMENTS 6,953,351 B2 * 10/2005 Fromm ..... H01R 13/514 439/101
10,411,377 B2 * 9/2019 Kawahara ..... H01R 12/707

FOREIGN PATENT DOCUMENTS

JP H10106670 4/1998
JP 3120730 12/2000
(Continued)

OTHER PUBLICATIONS

International Search Report for PCT/JP2018/020060 dated Jul. 25, 2018, 2 pages.

*Primary Examiner* — Phuong K Dinh
(74) *Attorney, Agent, or Firm* — Dority & Manning, P.A.

(57) ABSTRACT

Plug side connectors are prevented from moving relative to each other in the connecting/disconnecting direction, and one of the plug side connectors can be individually disconnected from the device side connector. The connector structure includes a longitudinal movement restricting protrusion on one of laterally facing side surfaces of the moveable member, which is resiliently deformably provided on the plug side housing, and a pair of stopper portions provided on another of the laterally facing side surfaces of the piece (48), and configured to restrict a movement of the longitudinal movement restricting protrusion of the laterally adjoining second housing (32) in the longitudinal direction by aligning with the longitudinal movement restricting protrusion (54) with respect to the longitudinal direction. When in an unlocked state, the longitudinal movement restricting protrusion (54) and the stopper portions (56, 58) are placed out of alignment with each other to release the restriction of the movement in the longitudinal direction.

7 Claims, 7 Drawing Sheets

(58) Field of Classification Search
USPC ..... 439/701
See application file for complete search history.

(56) References Cited

FOREIGN PATENT DOCUMENTS

| | | |
|---|---|---|
| JP | 2005322487 | 11/2005 |
| JP | 2014078370 | 5/2014 |
| JP | 2016122563 | 7/2016 |

* cited by examiner

CONNECTOR STRUCTURE HAVING A LONGITUDINAL MOVEMENT RESTRICTING PROTRUSION

CROSS REFERENCE TO RELATED APPLICATIONS

This application is the U.S. National Stage entry of International Application Number PCT/JP2018/020060 filed under the Patent Cooperation Treaty having a filing date of May 24, 2018, which claims priority to Japanese Patent Application No. 2017-111318 having a filing date of Jun. 6, 2017, which are incorporated herein by reference

TECHNICAL FIELD

The present invention relates to a connector structure, and more particularly to a connector structure including a device side connector and a plurality of plug side connectors to form a multi-pole connector structure.

BACKGROUND ART

A known connector structure for establishing electrical connection comprises a device side connector including a device side housing configured to be attached to a printed circuit board or the like and a plurality of device side terminals provided on the device side housing, and a plurality of plug side connectors each including a plug side housing and a plug side terminal provided on the plug side housing. The plug side connectors are configured to be selectively connected to the device side connector, and are mutually joined to and separated from one another (see Patent Documents 1 and 2, for instance).

In such a connector structure, when the plug side connectors are not connected to the device side connector (or when the plug side connectors are removed from the device side connector), the adjoining plug side connectors are not restricted from moving relative to each other in the connecting/disconnecting direction so that the plug side connects may move relatively to each other in the connecting/disconnecting direction. Therefore, the handling efficiency of the plug side connectors is impaired, and the work efficiency in connecting the plug side connects to the device side connector is impaired.

To overcome this problem, it is has been proposed to restrict the relative movement between the plug side connectors in the connecting/disconnecting direction by using a side retainer.

PRIOR ART DOCUMENT(S)

Patent Document(s)

Patent Document 1: JP2005-322487A
Patent Document 2: JP2014-78370A

SUMMARY OF THE INVENTION

Task to be Accomplished by the Invention

However, when a side retainer is used, and the plug side connectors are connected to the device side connector, it is not possible to pull out only one of the plug side connectors from the device side connector. All of the plug side connectors joined to one another by the side retainer have to be pulled out from the device side connector at the same time even when only one of the plug side connectors is desired to be pulled out.

An object of the present invention is to provide a connector structure in which a plurality of plug side connectors are prevented from moving relative to each other in the connecting/disconnecting direction with respect to the device side connector when the plug side connectors are disconnected from the device side connector, and one of the plug side connectors can still be individually disconnected from the device side connector when the plug side connectors are connected to the device side connector.

Means to Accomplished the Task

A connector structure according to one embodiment of the present invention is a connector structure having a first connector (10) including a first housing (12) and a plurality of first terminals (16) provided in the first housing (12), and a plurality of second connectors (30) each including a second housing (32) and a second terminal (36) provided in the second housing (32), the second connectors being configured to be inserted into and pulled out from the first connector in a longitudinal direction in a mutually aligned and adjoining relationship in a lateral direction, the connector structure comprising: a moveable member (48) provided on at least one of side surfaces of each second housing (32) facing in a vertical direction which is orthogonal to the lateral direction so as to be resiliently moveable in the vertical direction; a locking engaging portion (50) provided on the moveable member (48); a locking engaged portion (18) provided on the first housing (12) so as to be engaged by the locking engaging portion (50) when the second housing (32) is received in the first housing (12); a longitudinal movement restricting protrusion (54) provided on one of side surfaces of the moveable member (48) facing in the lateral direction so as to move in the vertical direction in synchronism with the locking engaging portion (50); and a stopper portion (56, 58) provided on another of the side surfaces of the moveable member (48) facing in the lateral direction so as to move in the vertical direction in synchronism with the locking engaging portion (50), and configured to restrict a movement of the longitudinal movement restricting protrusion (54) of the laterally adjoining second housing (32) in the longitudinal direction when the said second housing positionally coincide with the laterally adjoining second housing (32) with respect to the longitudinal direction; wherein the longitudinal movement restricting protrusion (54) and the stopper portion (56, 58) are configured to be placed out of alignment with each other with respect to the vertical direction to allow the longitudinal movement restricting protrusion to move in the longitudinal direction relative to the stopper portion of the laterally adjoining second housing when the moveable member (48) is moved in the vertical direction so as to disengage the locking engaging portion (50) from the locking engaged portion (18).

According to this arrangement, when the second connectors (30) are removed from the first connector (10), the relative longitudinal movement between the laterally adjoining second housings (32) can be prevented without requiring a side retainer. When the second connectors (30) are pulled out from the connector insertion chamber (14) of the first connector (10), the second connectors (30) positionally coincide with one another with respect to the longitudinal direction so that the handling of the second connectors (30)

is facilitated, and the work efficiency in connecting the second connectors to the first connector is improved.

When the second connectors (30) are inserted in the first connector (10), once the locking engaging portion (50) of one of the second connectors (30) is disengaged from the locking engaged portion (18), this second connector (30) is enabled to move in the longitudinal direction relative to the adjoining second connector (30) or the adjoining second connectors (30) so that this second connector (30) can be individually removed from the first connector (10).

In the above connector structure, preferably the locking engaging portion (50) is configured to move the moveable member (48) in the vertical direction in a resilient manner by abutting against the first housing (12) as the second housing (32) is inserted into the first housing (12), and engage the locking engaged portion (18) by regaining an original configuration thereof when the second housing (32) is completely inserted in the first housing (12).

According to this arrangement, upon completion of the insertion of the second housing (32), the locking engaging portion (50) is engaged by the locking engaged portion (18) in an automatic and reliable manner.

In the above connector structure, preferably the moveable member (48) is formed by a piece (48) provided on the second housing (32) made of plastic material with a gap defined with respect to a side surface of the second housing facing in the vertical direction, the piece (48) being integrally molded with the second housing (32) so as to form a single piece molded product.

According to this arrangement, since the piece (48) forming a part of the moveable member (48), and the second housing (32) jointly form an integrally molded single-piece member, no separate component is required for the moveable member, and the need for an assembly process for the moveable member can be eliminated so that the moveable member can be simple in structure and economical to manufacture.

In the above connector structure, preferably the piece (48) forms a beam extending along the second housing (32) in the longitudinal direction and having both longitudinal ends (48A, 48B) connected to the second housing (32).

According to this arrangement, since the piece (48) has no free end, inconveniences such as the entangling of the pieces (48) of the different second connectors (30) during the manufacturing process and the assembling process can be avoided.

In the above connector structure, preferably the piece (48) is provided with a lock release operation portion (52) configured to move the piece (48) in the vertical direction to disengage the locking engaging portion (50) from the locking engaged portion (18) by being pressed in the vertical direction.

According to this arrangement, the unlocking operation can be performed both reliably and easily by operating the unlocking operation portion (52).

In the above connector structure, preferably each second housing (32) is provided with a vertical movement restricting portion (40, 42, 44, 46) on each side surface thereof facing in the lateral direction to restrict a movement of the second housing in the vertical direction relative to the laterally adjoining second housing (32) by engaging with the corresponding vertical movement restricting portion provided on the laterally adjoining second housing.

According to this arrangement, the laterally mutually adjoining second housings (32) are prevented from moving relative to each other in the vertical direction during the insertion process or the like.

In the above connector structure, preferably each vertical movement restricting portion (40, 42, 44, 46) extends linearly along the second housing (32) in the longitudinal direction, and serves as a guide rail to slidably guide a movement of the laterally adjoining second housing (32) in the longitudinal direction.

According to this arrangement, the work efficiency of inserting and removing the second connector (30) with respect to the first connector (10) is improved.

Effect of the Invention

Thus, the present invention provides a connector structure in which a plurality of second connectors are prevented from moving relative to each other in the connecting/disconnecting direction with respect to the first connector when the second connectors are disconnected from the first connector, and still allows one of the second connectors to be individually disconnected from the first connector when the second connectors are connected to the first connector.

BRIEF DESCRIPTION OF THE DRAWING(S)

MODE(S) FOR CARRYING OUT THE INVENTION

Figure 1:
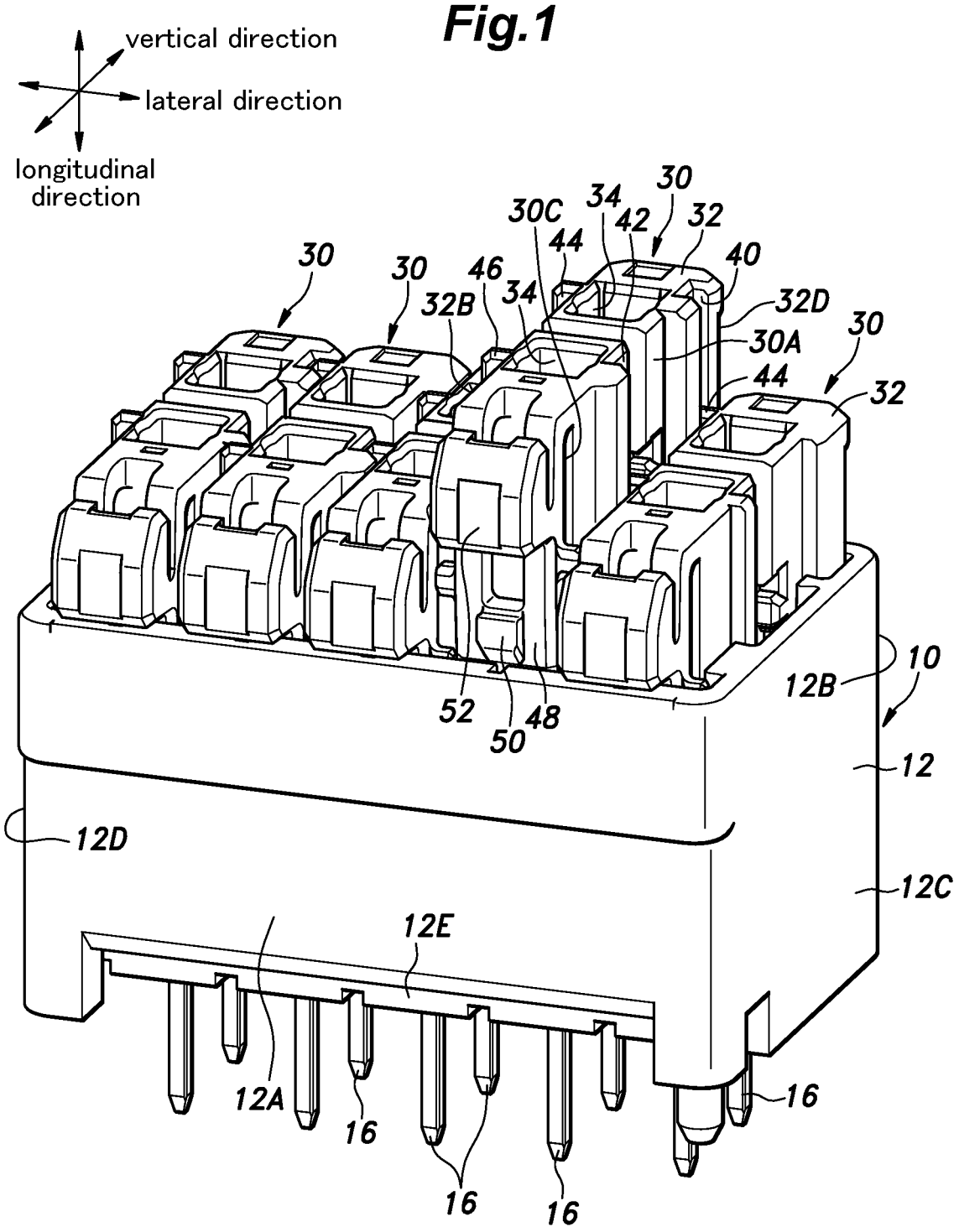
FIG. 1 is a perspective view showing an embodiment of a connector structure according to the present invention.
Figure 2:
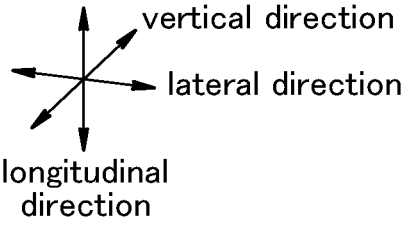
FIG. 2 is a perspective view of plug side connectors of the connector structure according to the embodiment.
Figure 2:
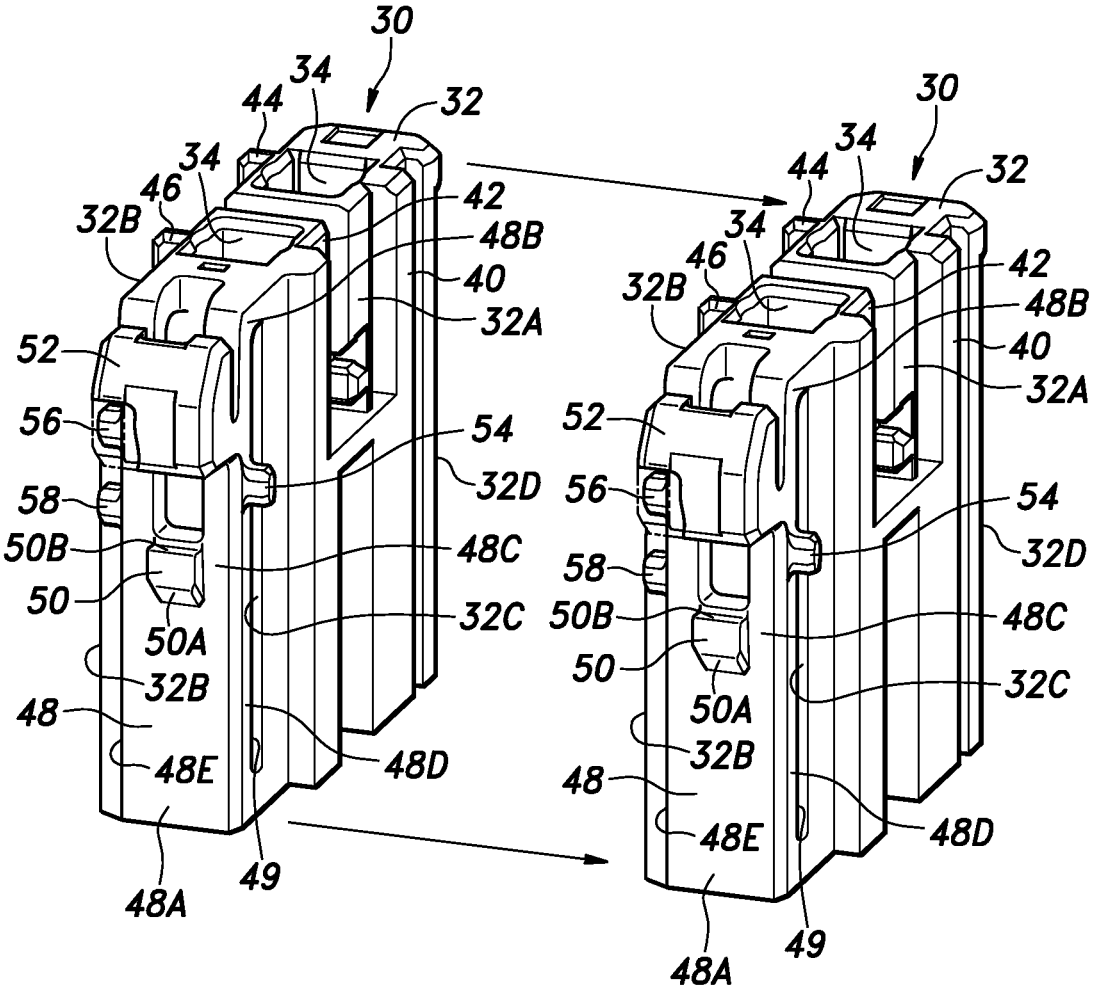
Figure 3:
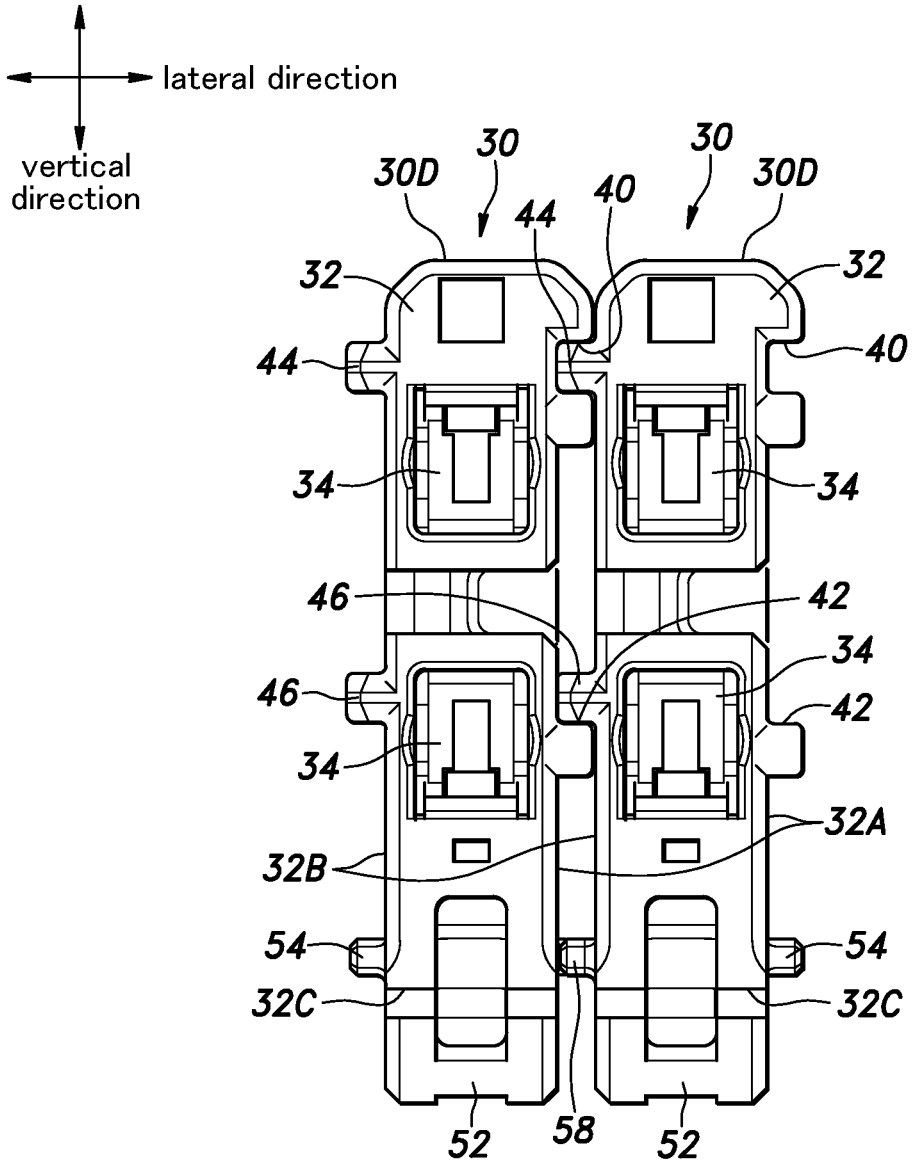
FIG. 3 is a plan view of the plug side connectors of the connector structure according to the embodiment.

An embodiment of a connector structure according to the present invention is described in the following with reference to FIGS. 1 to 7. In the following disclosure, the lateral direction (arranging direction) corresponds to the left and right direction as seen in FIGS. 1 to 3, the longitudinal direction (connecting/disconnecting direction) corresponds to the up and down direction as seen in FIGS. 1 to 7, and the vertical direction is a direction orthogonal to both the lateral direction and the longitudinal direction and corresponds to the left and right direction as seen in FIGS. 4 to 7.

As shown in FIGS. 1 and 4 to 7, the connector structure 1 includes a device side connector 10 that may be referred to as a first connector, and a plurality of plug side connectors 30 that may be referred to as second connectors.

The device side connector 10 is an electrical connector (header) which may be a surface mount connector, and includes a device side housing 12 formed by injection molding plastic material. The device side housing 12 is provided with four side walls 12A, 12B, 12C, 12D and a bottom wall 12E so as to define a rectangular box shape with an open top side (FIG. 1), and internally defines a single connector insertion chamber 14 having a rectangular space, and free of any partition wall. The connector insertion chamber 14 receives therein a plurality of plug side connectors 30 which are laterally arranged one closely next to the other in a single row and configured to be connected to and disconnected from (inserted into and pulled out from) the device side connector 10 in the longitudinal direction.

Figure 4:
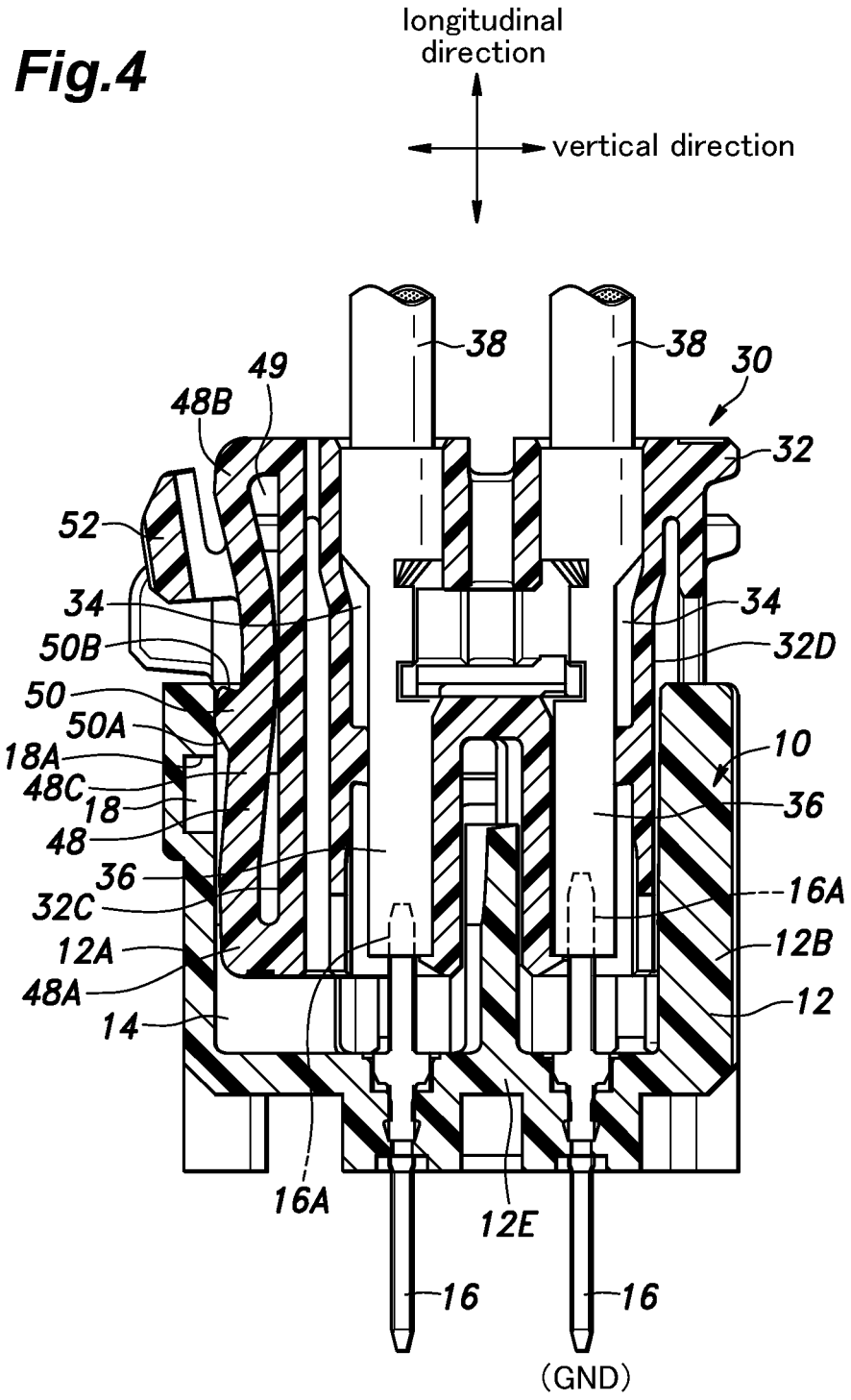
FIG. 4 is a sectional view showing a lock mechanism of the connector structure according to the embodiment during a connecting process.
Figure 5:
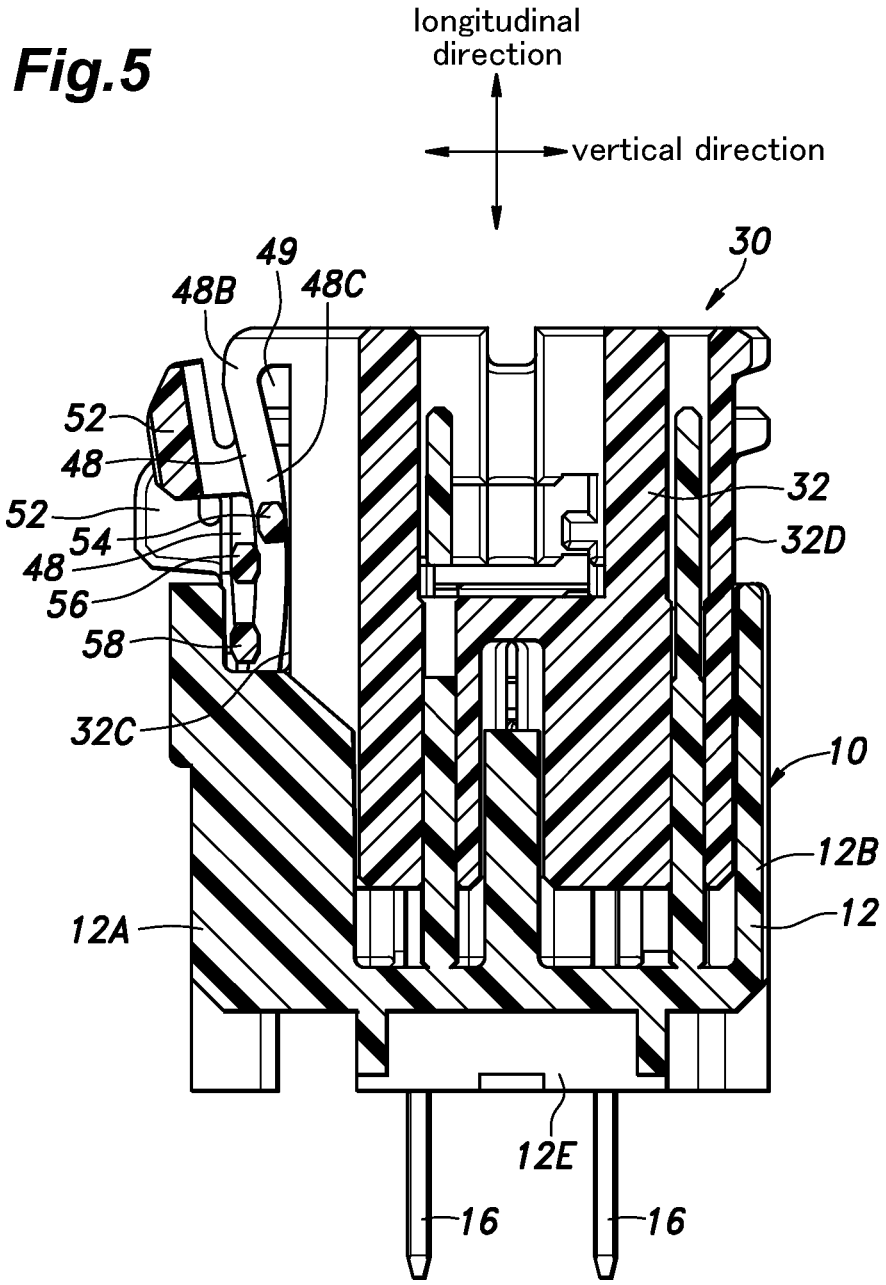
FIG. 5 is a sectional view showing a longitudinal movement restricting portion of the connector structure according to the embodiment during the connecting process.

As shown in FIGS. 4 and 5, the device side connector 10 is provided with a plurality of male terminals (device side terminals) 16. The male terminals 16 are arranged in two rows that are arranged in the vertical direction, and the male terminals 16 in each row are arranged in the lateral direction at a regular interval. Each male terminal 16 extends through the bottom wall 12E in the longitudinal direction, and is provided with a projection 16A that projects into the connector insertion chamber 14. The male terminal 16 indicated by "GND" in FIG. 4 is a grounding terminal, and the projection 16A of the grounding terminal has a greater projecting length than the projection 16A of the other male terminal 16. When connecting the plug side connector 30 to the device side connector 10, the grounding male terminal 16 establishes a conductive connection to the corresponding female terminal 36 (which will be described hereinafter) earlier than the non-grounding male terminal 16 establishes a conductive connection to the corresponding female terminal 36 so that static electricity is eliminated, and the device is protected from electrostatic charges when connecting the plug side connector 30 to the device side connector 10.

As shown in FIG. 1, the plug side connectors 30 are configured to be inserted into and pulled out from the connector insertion chamber 14 of the device side connector 10 in a laterally lined up and mutually closely adjoining condition.

As shown in FIGS. 1 to 7 each plug side connector 30 is provided with a plug side housing 32 made of a molded plastic material. The plug side housing 32 has a pair of side surfaces 32A and 32B facing in the lateral direction in parallel to each other, and a pair of side surfaces 32C and 32D facing in the vertical direction in parallel to each other so as to define a substantially rectangular shape. When the plug side connectors 30 are laterally aligned, either the side surfaces 32A and 32B of the plug side housing 32 oppose the side surfaces 32A and 32B of the adjoining plug side housing 32 on either side thereof, or one of the side surfaces 32A and 32B of the plug side housing 32 opposes the corresponding side surface of the adjoining plug side housing 32 on the corresponding side while the other side surface 32A, 32B opposes the corresponding side surfaces 32A, 32B of the adjoining plug side housing 32.

Figure 6:
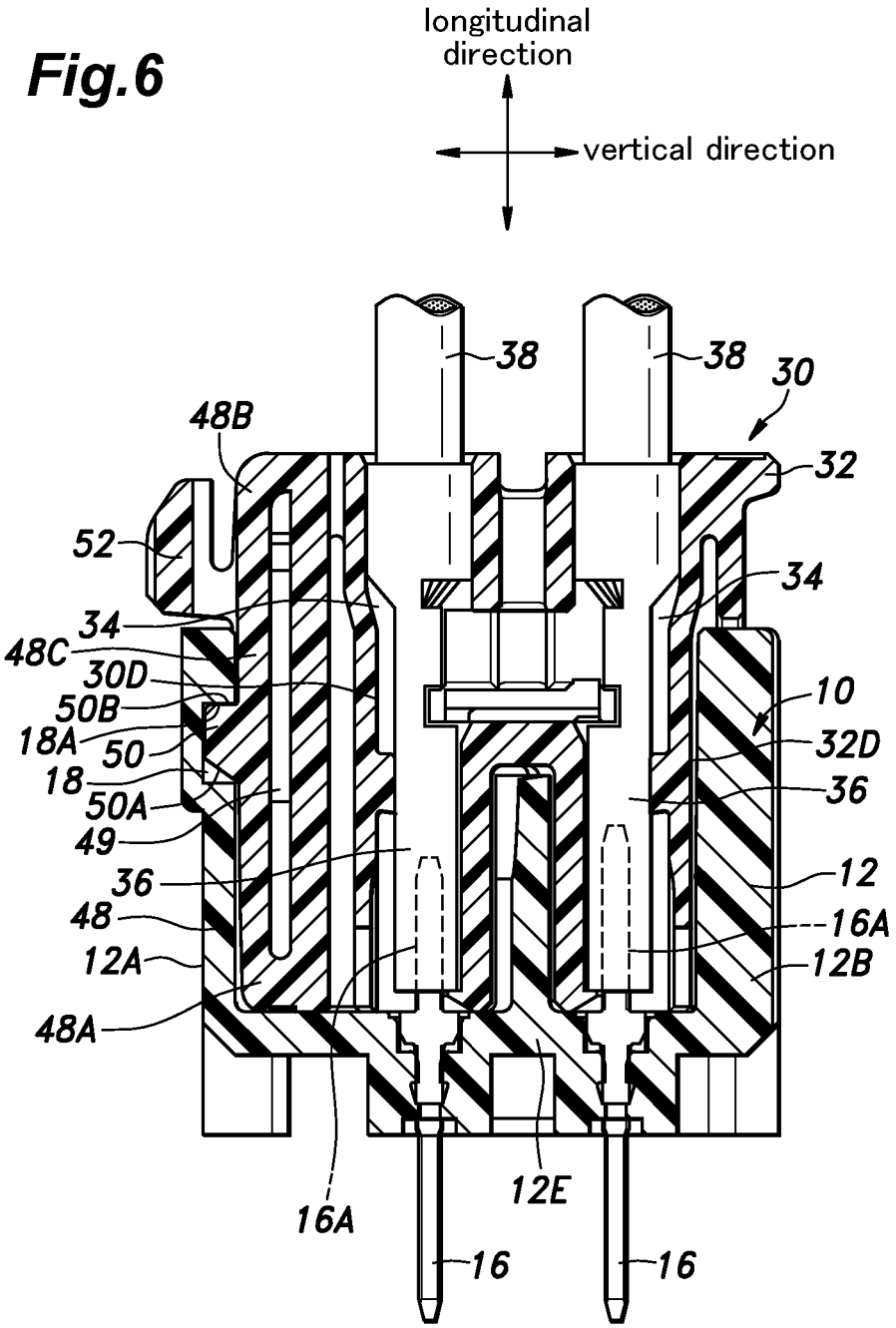
FIG. 6 is a sectional view showing the lock mechanism of the connector structure according to the embodiment upon completion of the connecting process.

As shown in FIGS. 1, 2, 4, and 6, the plug side housing 32 of each plug side connector 30 defines a pair of terminal chambers 34 arranged in the vertical direction and extending in the longitudinal direction. As shown in FIGS. 4 and 6, each terminal chamber 34 of the plug side connector 30 receives a metallic female terminal (plug terminal) 36 therein. Each female terminal 36 is electrically connected to an end of an insulated electric wire (cable) 38. Each female terminal 36 is configured to be electrically connected to the corresponding male terminal 16 when the plug side connector 30 is inserted into the connector insertion chamber 14 of the device side connector 10.

As shown in FIGS. 1 to 3, one of the laterally facing side surfaces (the right side surface in FIG. 2) of each plug side housing 32 is provided with a groove 40 defined by a pair of side walls and an engagement surface 42 delimited by a single side wall, the groove 40 and the engagement surface 42 extending linearly in the longitudinal direction in parallel to each other in a spaced apart relationship. The other laterally facing side surface (the left side surface in FIG. 2) is provided with a pair of ribs 44 and 46 extending linearly in the longitudinal direction in parallel to each other in a spaced apart relationship.

The groove 40, the engagement surface 42, and the ribs 44 and 46 jointly form a vertical movement restricting portion. The groove 40 and the engagement surface 42 of each plug side housing 32 engage with the ribs 44 and 46 of the adjoining plug side housing 32 so that the two mutually adjoining plug side housings 32 are enabled to slide relatively to each other in the longitudinal direction while keeping the two adjoining plug side housings 32 vertically aligned with each other by preventing the two adjoining plug side housings 32 moving vertically relative to each other.

The grooves 40, the engagement surfaces 42, and the ribs 44 and 46 thus jointly perform the function of a guiderail that slidably guides the relative longitudinal movement between the laterally adjoining plug side housings 32. Thereby, the work efficiency in inserting and pulling the plug side connectors 30 into and out of the connector insertion chamber 14 can be improved.

The grooves 40, the engagement surfaces 42, and the ribs 44 and 46 may be varied in vertical position and/or in shape for each pair of opposing side surfaces of the adjoining plug side housings 32 so that the plug side connectors 30 may be arranged in a prescribed order. In the illustrated embodiment, whereas the grooves 40 and the ribs 44 extend over the entire longitudinal length of the plug side housings 32, the engagement surfaces 42 and the ribs 46 extend over one half of the entire longitudinal length of the plug side housings 32. However, it may also be arranged such that the engagement surfaces 42 and the ribs 46 also extend over the entire longitudinal length of the plug side housings 32.

A piece 48 that serves as a moveable member is formed integrally on one of the vertically facing side surfaces 32C of the plug side housing 32. The piece 48 is thus molded integrally with the plug side housing 3. The piece 48 extends in the longitudinal direction with a gap 49 defined with respect to the side surface 32C, and has the longitudinal end parts 48A and 48B that are connected to the plug side housing 32 so as to form a beam supported at the two ends. As shown in FIGS. 4 and 5, the piece 48 is configured to elastically deform in a bow shape, and thus has an intermediate part 48C that is moveable in the vertical direction between the end parts 48A and 48B.

The intermediate part 48C (locking engaging portion) is integrally formed with a locking protrusion 50. The locking protrusion 50 protrudes away from the side surface 32C of the plug side housing 32, and the front surface of the locking protrusion 50 with respect to the insertion direction (longitudinal direction) is formed as an inclined surface 50A while the rear surface of the locking protrusion 50 is formed as a vertical upright surface 50B.

The inner surface (the surface defining the connector insertion chamber 14) of the side wall 12A of the device side housing 12 is provided with a locking recess 18 (locking engaged portion) configured to detachably engage the locking protrusion 50.

As shown in FIG. 4, the locking protrusion 50 is configured to advance into the connector insertion chamber 14 while abutting against the side wall 12A of the device side housing 12 so as to cause the piece 48 to be deformed toward the side wall 12A. Once the plug side housing 32 is received in the device side housing 12 (upon completion of the insertion of the plug side connector 30) as shown in FIG. 6, the locking protrusion 50 is engaged by the locking recess 18. In this engaged state, the plug side connector 30 is placed in a locked state wherein the plug side connector 30 is prevented from being pulled out of the device side connector 10 (moving in the longitudinal direction) by the vertical upright surface 50B of the locking protrusion 50 abutting against a vertical surface 18A of the opposing locking recess 18.

The engagement between the locking protrusion 50 and the locking recess 18 is effected in a resilient manner upon completion of the insertion of the plug side housing 32 into the device side housing 12 owing to the movement of the piece 48 to regain the original shape so that the engagement between the locking protrusion 50 and the locking recess 18 is achieved in a reliable manner upon completion of the insertion of the plug side housing 32 without requiring any special measure.

The piece 48 is provided with a lock release operation portion 52 in the vicinity of the end part 48B. More specifically, the lock release operation portion 52 is integrally molded with the piece 48 in a part thereof adjacent to the end part 48B of the piece 48 so as to project away from the side surface 32C of the plug side housing 32. In the locked state shown in FIG. 6, as the unlocking operation portion 52 is pressed in the vertical direction toward the side surface 32C, the piece 48 is elastically deflected toward the side wall 12A so that the locking protrusion 50 is removed from the recess 18. As a result, an unlocked state is achieved in which the engagement between the locking protrusion 50 and the locking recess 18 is released. In the unlocked state, the plug side housing 32 can be pulled out from the device side housing 12 by moving the plug side connector 30 in the corresponding longitudinal direction.

Thus, an unlocking operation or releasing of the locked state can be achieved both easily and reliably simply by pushing the unlocking operation portion 52.

Figure 7:
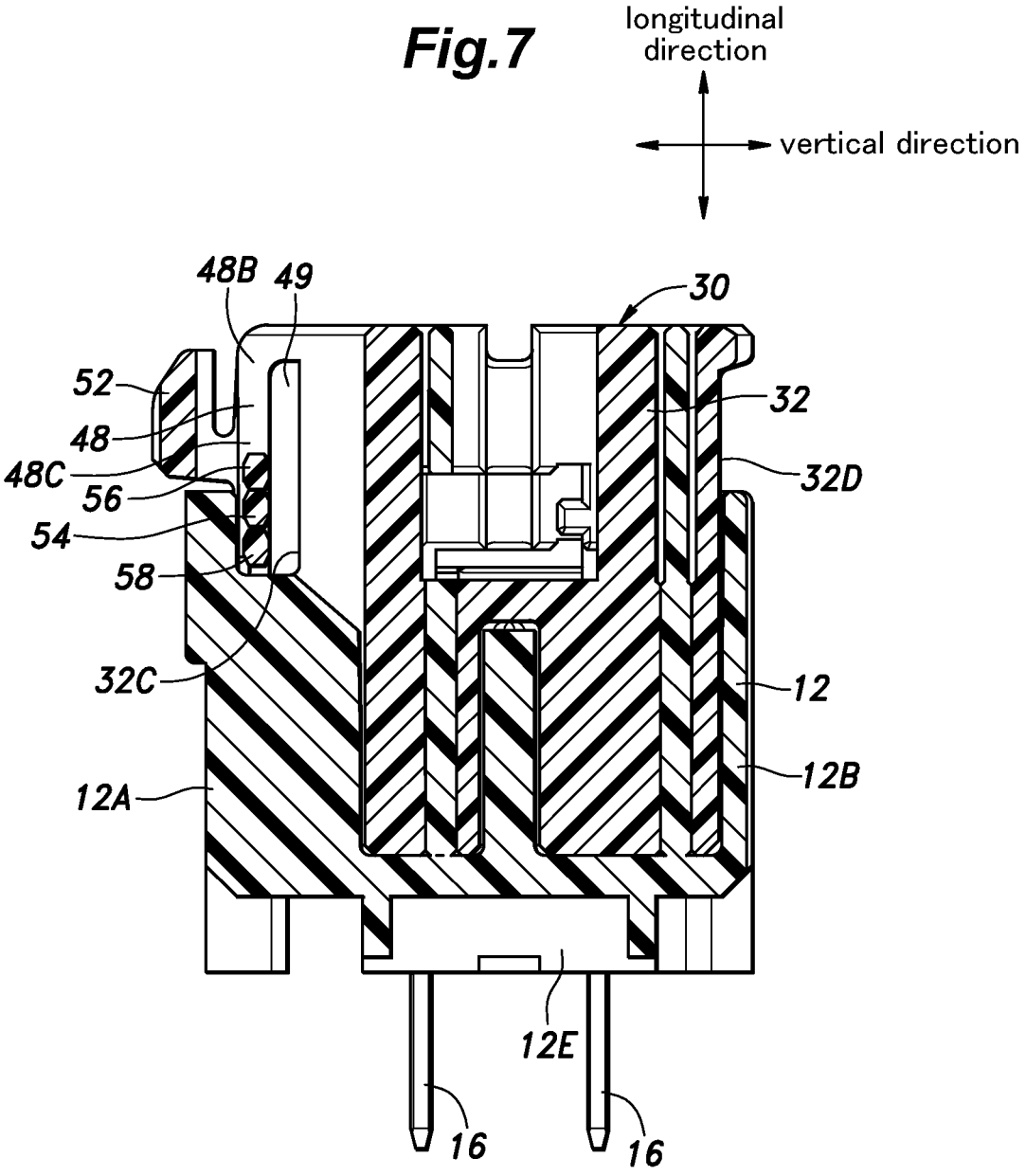
FIG. 7 is a sectional view showing the longitudinal movement restricting portion of the connector structure according to the embodiment upon completion of the connecting process.

As shown in FIGS. 2, 5, and 7, one of the side surfaces 48D of the intermediate part 48C of the piece 48 is integrally formed with a longitudinal movement restricting protrusion 54 which extends laterally, and moves in the vertical direction in synchronism with the locking protrusion 50 as a result of the elastic deformation mentioned earlier.

As shown in FIGS. 2, 5, and 7, the other side surface 48E of the intermediate part 48C of the piece 48 is integrally formed with a pair of stopper projections 56 and 58 positioned one behind the other. The stopper projections 56 and 58 project laterally from the side surface 48D by a distance which allows the longitudinal movement restricting protrusion 54 of the piece 48 of the laterally adjoining plug side housing 32 to be received therebetween in the vertical direction. The stopper projections 56 and 58 are thus configured to move in the vertical direction in synchronism with the locking projection 50 as the piece 48 undergoes the elastic deformation mentioned earlier.

As shown in FIG. 7, the stopper projections 56 and 58 are positioned such that when the plug side housing 32 positionally coincides with the laterally adjoining plug side housing 32 of the adjoining plug side housing 32 with respect to the longitudinal direction, the stopper projections 56 and 58 align with the longitudinal movement restricting protrusion 54 of the laterally adjoining plug side housing 32 with respect to the longitudinal direction to prevent the relative longitudinal movement of the longitudinal movement restricting protrusion 54, and as a result, the relative longitudinal movement between the adjoining plug side housings 32 is prevented. In other words, when the laterally adjoining plug side housings 32 are aligned such that the positions thereof with respect to the longitudinal direction coincide with each other, the longitudinal movement restricting protrusion 54 is engaged between the stopper projections 56 and 58 of the laterally adjoining plug side housing 32 and restricts the longitudinal movement of the laterally adjoining plug side housings 32 relative to each other.

Owing to the engagement between the longitudinal movement restricting protrusion 54 and the stopper projections 56 and 58 of the laterally adjoining plug side housings 32, the laterally adjoining plug side housings 32 are prevented from moving longitudinally relative to each other when the plug side connectors 30 are pulled out from the connector insertion chamber 14 of the device side connector 30 (in the disconnected state) without requiring a side retainer. As a result, when the plug side connectors 30 are pulled out from the connector insertion chamber 14 of the device side connector 30, the plug side connectors 30 positionally coincide with each other in the longitudinal direction, and the handling of the plug side connectors 30 is facilitated, and the work efficiency of connecting the plug side connectors 30 to the device side connector 10 is improved.

As shown in FIG. 5, when the piece 48 is elastically deformed toward the side wall 12A by an unlocking operation, the longitudinal movement restricting protrusion 54 thereof is disengaged from the stopper projections 56 and 58 of the adjoining plug side housing 32. Similarly, when the piece 48 is elastically deformed toward the side wall 12 by the unlocking operation, the stopper projections 56 and 58 thereof are disengaged from the longitudinal movement restricting protrusion 54 of the other adjoining plug side housing 32. Owing to these disengaging actions on either side, the middle plug side housing 32 can be moved in the longitudinal direction relative to the adjoining plug side housings 32.

Thus, when the unlocked state is produced by pushing the lock release operation portion 52 of one of the plug side connectors 30 while the plug side connectors 30 are received in the connector insertion chamber 14 of the device side connector 20 in the mutually laterally adjoining relationship, and the locking protrusion 50 is disengaged from the locking recess 18, this plug side connector 30 is enabled to move in the longitudinal direction relative to the laterally adjoining plug side connectors 30, and can be individually removed from the device side connector 10.

Since the piece 48 is formed as a moveable member integral with the plug side housing 32, no separate component part is required as the moveable member, and no assembly of the moveable member is required so that the connector structure can be simplified in structure and reduced in cost. The piece 48 may be provided with a cantilever structure having only one end part 48A thereof connected to the plug side housing 32, but it is more preferable to form the piece 48 as a beam supported at the both ends because owing to the absence of a free end, inconveniences such as the entangling of the pieces 48 of different plug side connectors during the manufacturing process and the assembling process can be avoided.

The present invention has been described in terms of a specific embodiment, but is not limited by such an embodiment, and can be modified in various ways without departing from the spirit of the present invention, as can be appreciated by a person skilled in the art.

For instance, the locking mechanism including the locking recess 18 and the locking protrusion 50 may be provided on each of the vertically facing side walls of the plug side housing 32 as required. The grooves 40 and the ribs 44 may be configured as dovetail joints so that the lateral movement of the laterally adjoining plug side housings 32 may be restricted. The number of plug side connectors 30 that are to be connected to the device side connector 10 at the same time is not limited to five as illustrated in FIG. 1, but may be otherwise. The connector structure of the present invention is not limited to a combination of a device side connector 10 and plug side connectors 30, but may also be a combination of plugs and sockets which connected to respective wires or cables.

The various components of the illustrated embodiments are not entirely essential for the present invention, but can be retained and omitted as required without departing from the spirit of the present invention,

GLOSSARY OF TERMS

| | |
|---|---|
| 10: device side connector (first connector) | 12: device side housing (first housing) |
| 12A: side wall | 12B: side wall |
| 12C: side wall | 12D: side wall |
| 12E: bottom wall | 14: connector insertion chamber |
| 16: male terminal (first terminal) | 16A: protruding part |
| 18: locking recess (locking engaged portion) | |
| 18A: vertical surface | 30: plug side connector (second connector) |
| 32: plug side housing (second housing) | 32A: side surface |
| 32B: side surface | 32C: side surface |
| 32D: side surface | 34: terminal chamber |
| 36: female terminal (second terminal) | 38: insulated wire |
| 40: groove (vertical movement restricting portion) | |
| 42: engagement surface (vertical movement restricting portion) | |
| 44: rib (vertical movement restricting portion) | |
| 46: rib (vertical movement restricting portion) | |
| 48: piece (moveable member) | 49: gap |
| 48A: end part | 48B: end part |
| 48C: intermediate part | 48D: side surface |
| 48E: side surface | |
| 50: locking protrusion (locking engaging portion) | |
| 50A: inclined surface | 50B: vertical upright surface |
| 52: lock release operation portion | |
| 54: longitudinal movement restricting protrusion | |
| 56: stopper projection (stopper portion) | 58: stopper projection (stopper portion) |

The invention claimed is:

1. A connector structure having a first connector including a first housing and a plurality of first terminals provided in the first housing, and a plurality of second connectors each including a second housing and a second terminal provided in the second housing, the second connectors being configured to be inserted into and pulled out from the first connector in a longitudinal direction in a mutually aligned and adjoining relationship in a lateral direction, the connector structure comprising:

a moveable member provided on at least one of side surfaces of each second housing facing in a vertical direction which is orthogonal to the lateral direction so as to be resiliently moveable in the vertical direction;

a locking engaging portion provided on the moveable member;

a locking engaged portion provided on the first housing so as to be engaged by the locking engaging portion when the second housing is received in the first housing;

a longitudinal movement restricting protrusion provided on one of side surfaces of the moveable member facing in the lateral direction so as to move in the vertical direction in synchronism with the locking engaging portion; and a stopper portion provided on another of the side surfaces of the moveable member facing in the lateral direction so as to move in the vertical direction in synchronism with the locking engaging portion, and configured to restrict a movement of the longitudinal movement restricting protrusion of the laterally adjoining second housing in the longitudinal direction when the said second housing positionally coincide with the laterally adjoining second housing with respect to the longitudinal direction;

wherein the longitudinal movement restricting protrusion and the stopper portion are configured to be placed out of alignment with each other with respect to the vertical direction to allow the longitudinal movement restricting protrusion to move in the longitudinal direction relative to the stopper portion of the laterally adjoining second housing when the moveable member is moved in the vertical direction so as to disengage the locking engaging portion from the locking engaged portion.

2. The connector structure according to claim 1, wherein the locking engaging portion is configured to move the moveable member in the vertical direction in a resilient manner by abutting against the first housing as the second housing is inserted into the first housing, and engage the locking engaged portion by regaining an original configuration thereof when the second housing is completely inserted in the first housing.

3. The connector structure according to claim 1, wherein the moveable member is formed by a piece provided on the second housing made of plastic material with a gap defined with respect to a side surface of the second housing facing in the vertical direction, the piece being integrally molded with the second housing so as to form a single piece molded product.

4. The connector structure according to claim 3, wherein the piece forms a beam extending along the second housing in the longitudinal direction and having both longitudinal ends connected to the second housing.

5. The connector structure according to claim 3, wherein the piece is provided with a lock release operation portion configured to move the piece in the vertical direction to disengage the locking engaging portion from the locking engaged portion by being pressed in the vertical direction.

6. The connector structure according to claim 1, wherein each second housing is provided with a vertical movement restricting portion on each side surface thereof facing in the lateral direction to restrict a movement of the second housing in the vertical direction relative to the laterally adjoining second housing by engaging with the corresponding vertical movement restricting portion provided on the laterally adjoining second housing.

7. The connector structure according to claim 6, wherein each vertical movement restricting portion extends linearly along the second housing in the longitudinal direction, and serves as a guide rail to slidably guide a movement of the laterally adjoining second housing in the longitudinal direction.

* * * * *